US006718665B2

(12) United States Patent
Hess et al.

(10) Patent No.: US 6,718,665 B2
(45) **Date of Patent: *Apr. 13, 2004**

(54) FLAME SIMULATING ASSEMBLY

(75) Inventors: Kristoffer Hess, Cambridge (CA); Kelly Stinson, Kitchener (CA)

(73) Assignee: Dimplex North America Limited, Cambridge (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/101,013

(22) Filed: Mar. 20, 2002

(65) Prior Publication Data

US 2002/0095832 A1 Jul. 25, 2002

Related U.S. Application Data

(63) Continuation-in-part of application No. 09/443,324, filed on Nov. 19, 1999, now Pat. No. 6,363,636, which is a division of application No. 08/868,948, filed on Jun. 4, 1997, now Pat. No. 6,050,011, which is a continuation of application No. 08/649,510, filed on May 17, 1996, now Pat. No. 5,642,580.

(51) Int. Cl.[7] ..... G09F 19/00
(52) U.S. Cl. ..... 40/428
(58) Field of Search ..... 40/428; 362/92, 362/253, 806; 392/348; 472/65

(56) References Cited

U.S. PATENT DOCUMENTS

| | | | | | |
|---|---|---|---|---|---|
| 1,719,622 | A | * | 7/1929 | Price | 40/428 |
| 1,843,279 | A | | 2/1932 | Gritt | |
| 2,285,535 | A | | 6/1942 | Schlett | |
| 2,708,114 | A | | 5/1955 | Hancock | |
| 3,395,475 | A | | 8/1968 | Moss | |
| 3,395,476 | A | | 8/1968 | Moss et al. | |
| 3,445,948 | A | | 5/1969 | Moss et al. | |
| 3,603,013 | A | | 9/1971 | Reed et al. | |
| 4,965,707 | A | | 10/1990 | Butterfield | |
| 5,195,820 | A | * | 3/1993 | Rehberg | 126/523 |
| 5,648,827 | A | * | 7/1997 | Shaw | 349/61 |
| 6,050,011 | A | | 4/2000 | Hess et al. | |
| 6,302,555 | B1 | | 10/2001 | Bristow | |
| 6,363,636 | B1 | * | 4/2002 | Hess et al. | 40/428 |
| 6,393,207 | B1 | | 5/2002 | Martin et al. | |
| 2002/0168182 | A1 | | 11/2002 | Martin et al. | |
| 2002/0170215 | A1 | | 11/2002 | Mix et al. | |
| 2002/0175215 | A1 | | 11/2002 | Webster et al. | |
| 2003/0126775 | A1 | | 7/2003 | Corry et al. | |

FOREIGN PATENT DOCUMENTS

| | | | | | |
|---|---|---|---|---|---|
| EP | 1 020 685 | A2 | | 7/2000 | |
| GB | 459 941 | | | 7/1936 | |
| GB | 957591 | | | 5/1964 | |
| GB | 968568 | | | 9/1964 | |
| GB | 975009 | | | 11/1964 | |
| GB | 978364 | | | 12/1964 | |
| GB | 978365 | | | 12/1964 | |
| GB | 1024047 | | | 3/1966 | |
| GB | 1186655 | | | 4/1970 | |
| GB | 1443772 | | | 7/1976 | |
| GB | 2210969 | A | | 6/1989 | |
| GB | 2222000 | A | | 2/1990 | |
| GB | 2298073 | | * | 8/1996 | 40/428 |
| GB | 2 302 172 | A | | 1/1997 | |
| GB | 2 321 700 | A | | 8/1998 | |

OTHER PUBLICATIONS

European Search Report, EP 03 25 1684, European Search Report, dated Aug. 5, 2003.

* cited by examiner

*Primary Examiner*—Brian K. Green

(57) ABSTRACT

A flame simulating assembly for providing an image of flames transmitted in a fluctuating light. The flame simulating assembly has a simulated fuel bed, a light source, a screen disposed behind the simulated fuel bed for diffusing and transmitting light, and a flicker element for creating the fluctuating light, the flicker element being positioned in a path of light from the light source. The simulated fuel bed defines a profile viewable by an observer. In addition, the screen includes a curved portion which is curved in a vertical direction and in a horizontal direction to correspond to the profile of the simulated fuel bed. Also, the curved portion of the screen is positioned adjacent to the simulated fuel bed. The fluctuating light transmitted through the screen is attenuated and a three-dimensional image of flames appears to curve around the profile of the simulated fuel bed.

12 Claims, 11 Drawing Sheets

FLAME SIMULATING ASSEMBLY

This is a continuation-in-part of application Ser. No. 09/443,324, which was a division of Application Ser. No. 08/868,948, filed Jun. 4, 1997 (now U.S. Pat. No. 6,050,011), which was a continuation-in-part of application Ser. No. 08/649,510, filed May 17, 1996 (now U.S. Pat. No. 5,642,580).

FIELD OF THE INVENTION

The present invention relates generally to simulated fireplaces and, more particularly, to flame simulating assemblies for electric fireplaces and the like.

BACKGROUND OF THE INVENTION

Electric fireplaces are popular because they provide visual qualities approximating those of real fireplaces without the costs and complications associated with venting of combustion gasses. An assembly for producing a realistic simulated flame for electric fireplaces is disclosed in U.S. Pat. No. 4,965,707 (Butterfield). In the Butterfield patent, an assembly is disclosed in which billowing ribbons and a diffusion screen are used for simulating flames. The assembly disclosed in the Butterfield patent also includes a screen which is generally planar and through which an image of flames is transmitted.

There is a need for an assembly for producing an image of flames that more realistically resembles flames from burning fuel.

SUMMARY OF THE INVENTION

In a broad aspect of the present invention, there is provided a flame simulating assembly for providing an image of flames transmitted in a fluctuating light having a simulated fuel bed, a light source, a screen disposed behind the simulated fuel bed for diffusing and transmitting light, and a flicker element for creating the fluctuating light positioned in a path of light from the light source. The simulated fuel bed defines a profile viewable by an observer. In addition, the screen includes a curved portion which is curved in a vertical direction and in a horizontal direction to correspond to the profile of the simulated fuel bed. Also, the curved portion of the screen is positioned adjacent to the simulated fuel bed. The fluctuating light transmitted through the screen is attenuated and a three-dimensional image of flames appears to curve around the profile of the simulated fuel bed.

In another aspect of the present invention, there is provided a flame simulating assembly for providing an image of flames transmitted in a fluctuating light, the flame simulating assembly being adapted for use with a simulated fuel bed. The simulated fuel bed defines a profile viewable by an observer. This embodiment of the flame simulating assembly includes alight source, a screen positioned behind the simulated fuel bed for diffusing and transmitting light, and a flicker element for creating the fluctuating light, the flicker element being positioned in a path of light from the light source. Also, the screen includes a curved portion which is curved in a vertical direction and in a horizontal direction to correspond to the profile of the simulated fuel bed. In addition, the curved portion of the screen is positioned adjacent to the simulated fuel bed. Accordingly, the fluctuating light transmitted through the screen is attenuated and a three-dimensional image of flames appears to curve around the profile of the simulated fuel bed.

In yet another aspect of the present invention, there is provided a flame simulating assembly for providing an image of flames transmitted in a fluctuating light, the flame simulating assembly being adapted for use with a simulated fuel portion. This embodiment of the flame simulating assembly includes a simulated ember bed portion, a light source, a screen, and a flicker element for creating the fluctuating light, the flicker element being positioned in a path of light from the light source. The simulated ember bed portion is adapted to receive the simulated fuel portion to form a simulated fuel bed. In this embodiment of the flame simulating assembly as well, the simulated fuel bed defines a profile viewable by an observer. The screen is positioned behind the simulated ember bed portion for diffusing and transmitting light, and includes a curved portion which is curved in a vertical direction and in a horizontal direction to correspond to the profile of the simulated fuel bed. Also, the curved portion of the screen is positioned adjacent to the simulated ember bed portion. The result is that the fluctuating light transmitted through the screen is attenuated and a three-dimensional image of flames appears to curve around the profile of the simulated fuel bed.

In accordance with another aspect of the present invention, there is provided a flame simulating assembly for providing an image of flames transmitted in a fluctuating light including a simulated fuel bed, a light source, a screen having a front member disposed behind the simulated fuel bed and a diffusing member disposed behind the front member for diffusing and transmitting light, and a flicker element for creating the fluctuating light, the flicker element being positioned in a path of light from the light source. The simulated fuel bed defines a profile viewable by an observer. In addition, the front member has a partially reflective front surface for reflecting and transmitting light, and the diffusing member includes a curved portion. Also, the curved portion is curved in a vertical direction and in a horizontal direction to correspond to the profile of the simulated fuel bed, and is positioned adjacent to the simulated fuel bed. Accordingly, the fluctuating light transmitted through the screen is attenuated and a three-dimensional image of flames appears to curve around the profile of the simulated fuel bed.

In another embodiment of the present invention, there is provided a flame simulating assembly for providing an image of flames transmitted in a fluctuating light including a simulated fuel bed, a light source, a screen disposed behind the simulated fuel bed for diffusing and transmitting light, and a flicker element for creating the fluctuating light, the flicker element being positioned in a path of light from the light source. In addition, the screen includes a conoid concavity positioned adjacent to the simulated fuel bed. The fluctuating light transmitted through the screen is attenuated and a three-dimensional image of flames appears to curve around the simulated fuel bed.

In yet another aspect of the present invention, there is provided a flame simulating assembly for providing an image of flames transmitted in a fluctuating light including a simulated fuel bed, a light source, a screen having a front member disposed behind the simulated fuel bed and a diffusing member disposed behind the front member for diffusing and transmitting light, and a flicker element for creating the fluctuating light, the flicker element being positioned in a path of light from the light source. In addition, the front member has a partially reflective front surface for reflecting and transmitting light, and the diffusing member has a conoid concavity positioned adjacent to the simulated fuel bed. Accordingly, the fluctuating light transmitted through the screen is attenuated and a three-dimensional image of flames appears to curve around the simulated fuel bed.

In accordance with another aspect of the present invention, there is provided a flame simulating assembly for providing an image of flames transmitted in a fluctuating light including a simulated fuel bed, a light source, a screen having a front surface disposed behind the simulated fuel bed for diffusing and transmitting light, and a flicker element for creating the fluctuating light, the flicker element being positioned in a path of light from the light source. In this embodiment, the screen has a back surface which is curved in a vertical direction and in a horizontal direction. Also, the back surface of the screen is sufficiently spaced from the front surface thereof that the fluctuating light transmitted through the screen is attenuated and a three-dimensional image of flames appears through the screen.

BRIEF DESCRIPTION OF THE DRAWINGS

The invention will be better understood with reference to the drawings, in which.

DETAILED DESCRIPTION OF THE INVENTION

Figure 1:
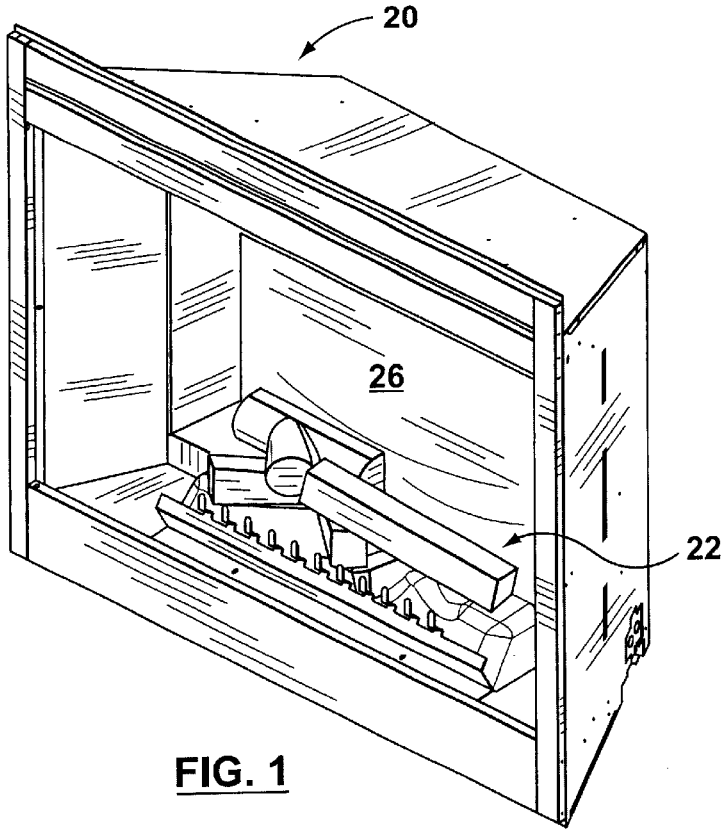
FIG. 1 is an isometric view of a preferred embodiment of the flame simulating assembly.
Figure 2:
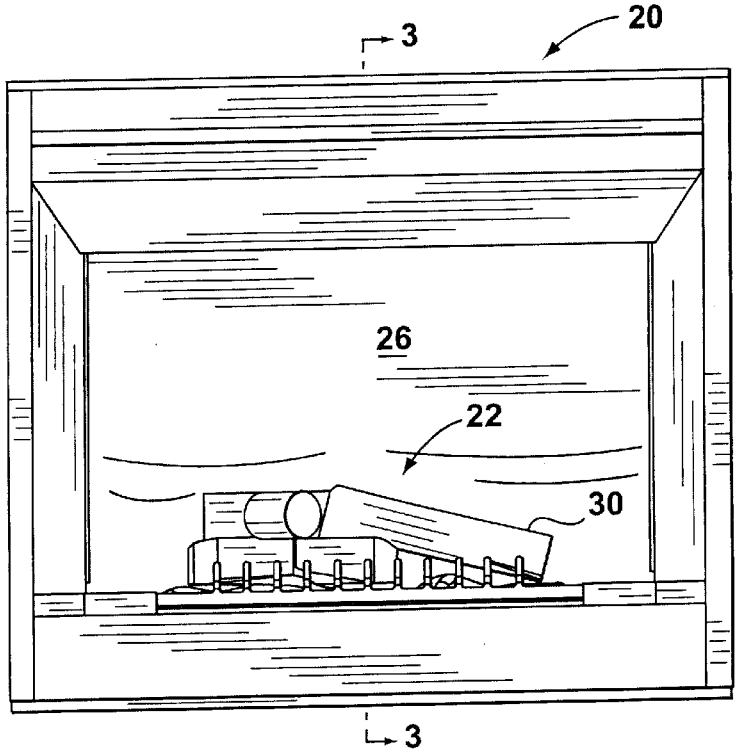
FIG. 2 is a front view of the flame simulating assembly of FIG. 1.
Figure 3:
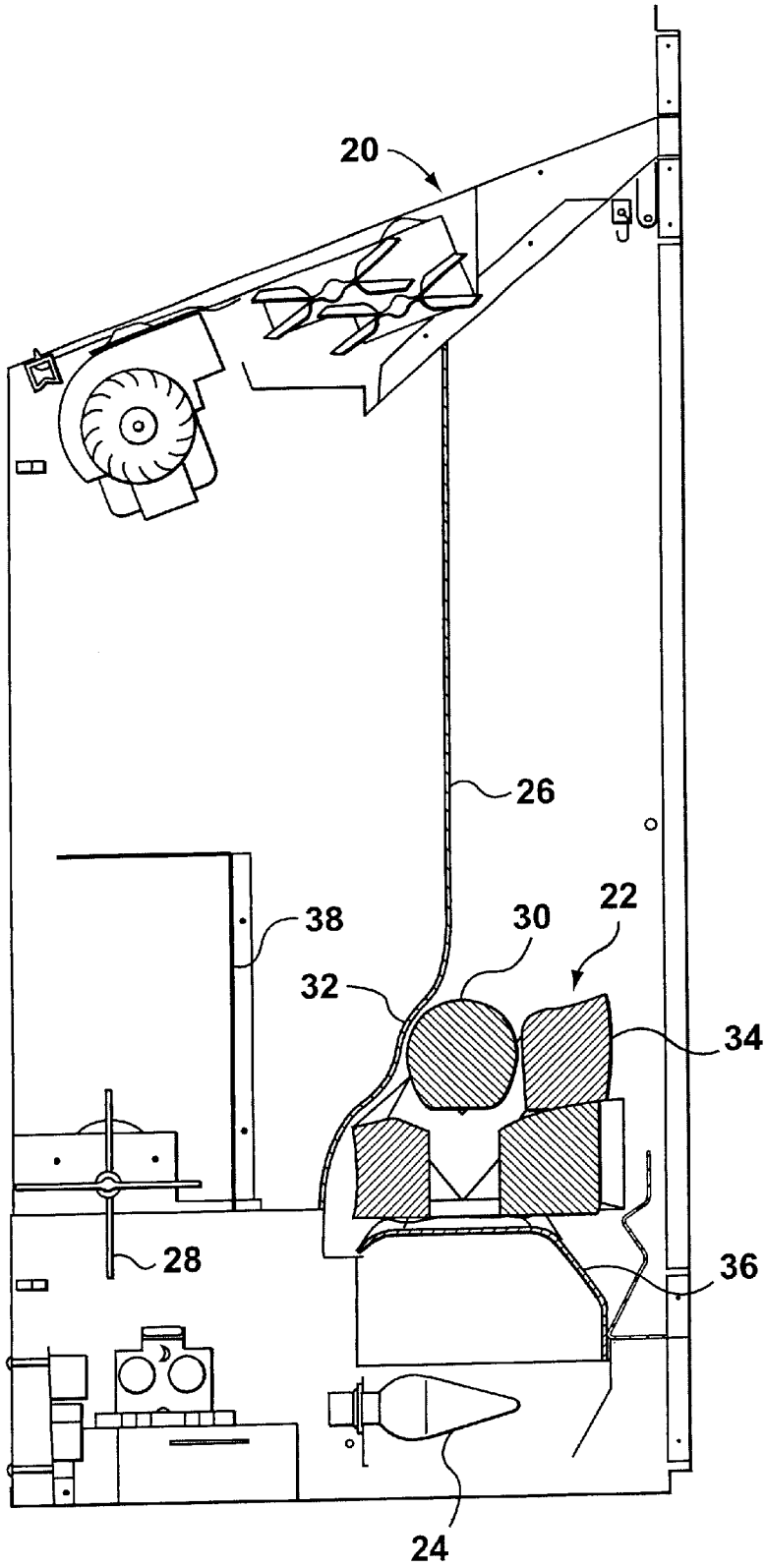
FIG. 3 is a cross-section of the flame simulating assembly of FIG. 1 taken along line 3—3 in FIG. 2, drawn at a larger scale.

Reference is first made to FIG. 1 to describe a preferred embodiment of a flame simulating assembly indicated generally by the numeral 20 in accordance with the invention. As can be seen in FIGS. 1–3, the flame simulating assembly includes a simulated fuel bed 22, a light source 24, a screen 26, and a flicker element 28. The screen 26 is disposed behind the simulated fuel bed 22. As will be described, the screen 22 is for diffusing and transmitting light.

As can be seen in FIG. 2, the simulated fuel bed 22 defines a profile 30 which is viewable by an observer (not shown) observing, from a position in front of the flame simulating assembly 20, the simulated fuel bed 22 and the screen 26. FIG. 3 shows that the screen 26 includes a curved portion 32 which is curved in a vertical direction and in a horizontal direction to correspond to the profile 30 of the simulated fuel bed 22. The curved portion 32 of the screen 26 is positioned adjacent to the simulated fuel bed 22, as will be described. In addition, the flicker element 28 is positioned in a path of light from the light source 24, and the flicker element 28 creates a fluctuating light. The fluctuating light transmitted through the screen 26 is attenuated and a three-dimensional image of flames appears to curve around the profile 30 of the simulated fuel bed 22.

Preferably, the simulated fuel bed 22 includes a simulated fuel portion comprising a plurality of simulated logs 34 positioned on a simulated ember bed portion 36. The simulated fuel bed 22 preferably is formed as described in U.S. Pat. No. 6,050,011, which is incorporated herein by reference.

The screen 26 may conveniently be formed by vacuum-forming a sheet of plastic to the desired shape. Preferably, the screen 26 comprises a single sheet of polyethylene having a haze (measured in accordance with ASTM D 1003-0) in excess of 30 per cent. The curvature of the curved portion 32 preferably follows the profile 30 of the simulated fuel bed 22 to give the appearance that the image of flames transmitted through the screen 26 is emanating from the simulated fuel bed 26. In addition, the curvature of the curved portion 32, in the horizontal direction along simulated fuel bed 26, preferably tracks the particular angle at which a simulated log lies on the simulated ember bed portion 36. At a horizontal portion on the simulated fuel bed 22 where no simulated fuel portion appears, the screen 26 is locally curved to be closer to the simulated fuel bed 22 to give the appearance that the image of flames transmitted through the screen 26 is emanating from the embers between the simulated logs 34 of the simulated fuel bed 22.

The light source 24 can comprise one or more electric light bulbs, halogen lamps, or other suitable lighting means.

It will be appreciated that various arrangements can be used for the flicker element 28. Preferably, the flicker element 28 is constructed as described in U.S. Pat. No. 6,050,011.

It is also preferred that the flame simulating assembly 20 includes a flame effect element 38, shown in FIG. 3. While various other arrangements can be employed, the flame effect element 38 is preferably in the form as described in U.S. Pat. No. 6,050,011.

In use, the flicker element 28 causes light from the light source 24 to fluctuate or flicker. The fluctuating light is reflected or transmitted from the flicker element 28 to the screen 26, and is transmitted through the screen 26. Also, the fluctuating light transmitted through the screen 26 is attenuated and appears as a three-dimensional image. The image of flames which is transmitted through the curved portion 32 of the screen 26 appears to curl, or curve, around the profile 30 of the simulated fuel bed 22, providing a realistic image of flames. Because of the curvature of the curved portion 32, the three-dimensional image of flames transmitted through the curved portion 32 appears to curve around the simulated fuel bed 22 similarly to flames curling around fuel in a real fire.

As noted above, it is preferred that the flame simulating assembly 20 includes the flame effect element 38, positioned in a path of the fluctuating light between the flicker element 28 and the screen 26. The flame effect element 38 configures the fluctuating light so that an image of flames is transmitted through the screen 26.

Additional embodiments of the invention are shown in FIGS. 4–14. In FIGS. 4–14, elements are numbered so as to correspond to like elements shown in FIGS. 1–3.

Figure 4:
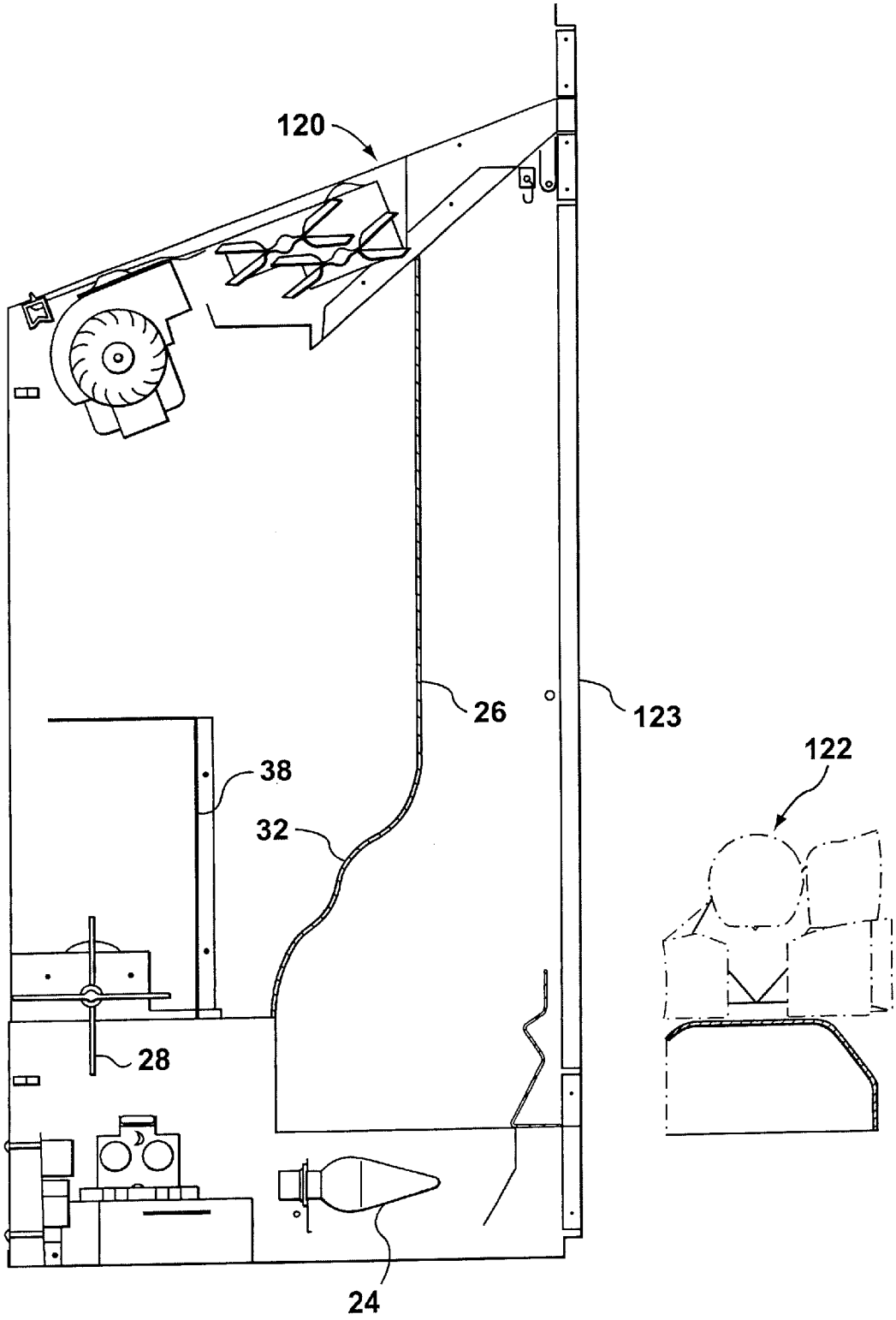
FIG. 4 is a cross-section of another embodiment of the flame simulating assembly of the invention.

In FIG. 4, another embodiment of the flame simulating assembly 120 is shown in which the flame simulating assembly 120 is adapted for use with a simulated fuel bed 122. The simulated fuel bed 122 can comprise a vacuum-formed plastic assembly formed and colored to resemble simulated fuel and a simulated ember portion supporting the simulated fuel, as shown in ghost outline in FIG. 4. Alternatively, the simulated fuel bed can be, for example, a grate (not shown) supporting a simulated fuel portion (not shown).

In use, the simulated fuel bed 122 may be positioned adjacent to the screen 26 or disposed outside the flame simulating assembly 120, adjacent to a transparent front panel 123. The simulated fuel bed 122 in any event has a profile 130 viewable by an observer (not shown), and it is preferable that the simulated fuel bed 122 be positioned substantially adjacent to the curved portion 32. The simulation of flames appears more realistic when the image of flames transmitted through the screen 26 appears to curve around the profile of the simulated fuel bed 122, and this appearance is more easily achieved when the simulated fuel bed 122 and the curved portion 32 of the screen 26 are positioned in close proximity to each other.

Figure 5:
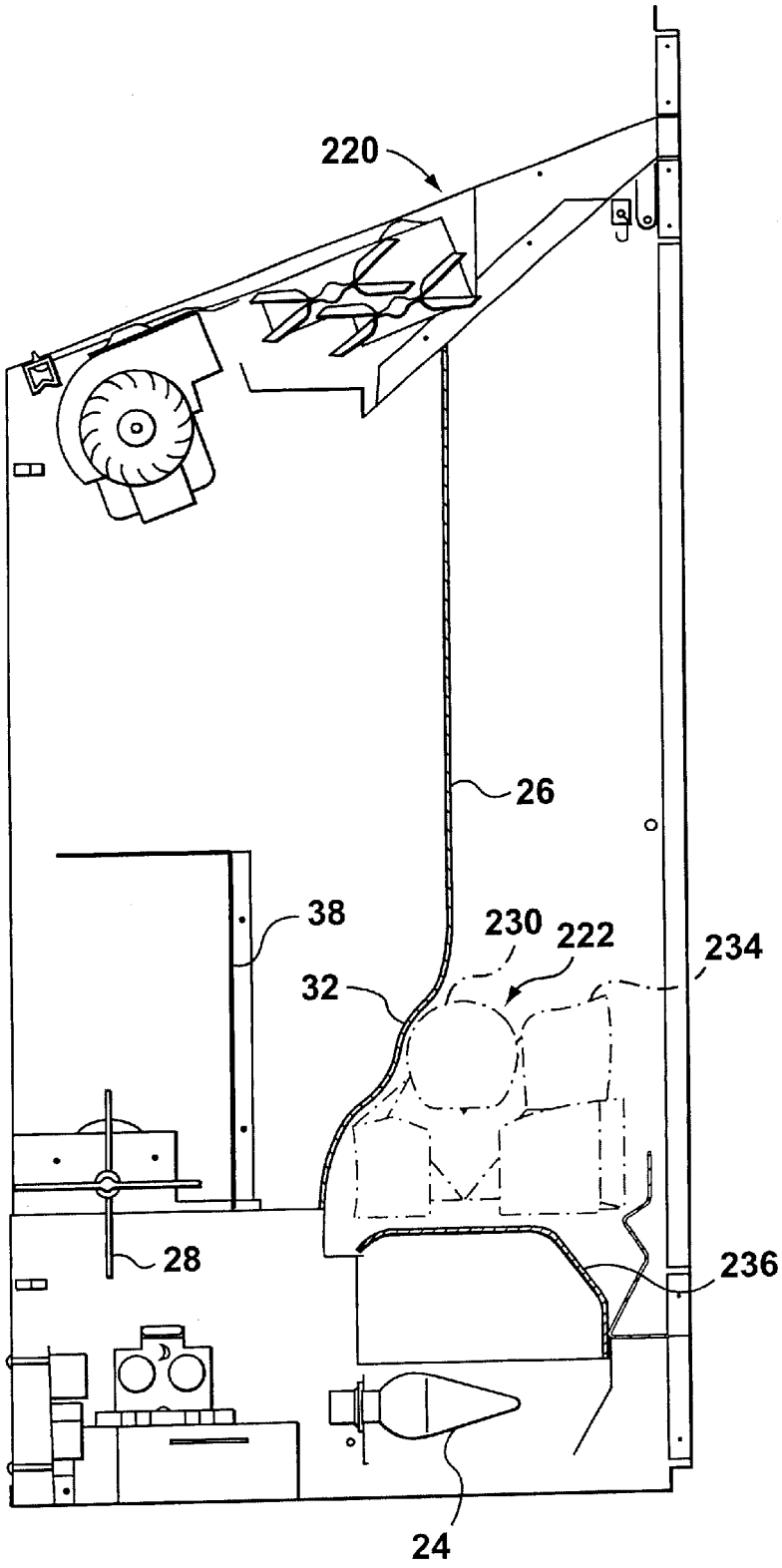
FIG. 5 is a cross-section of yet another embodiment of the flame simulating assembly of the invention.

FIG. 5 illustrates another embodiment of the flame simulating assembly 220. In this embodiment, the flame simulating assembly 220 is adapted for use with a simulated fuel portion 234, the simulated fuel portion 234 being shown in ghost outline in FIG. 5. The flame simulating assembly 220 includes a simulated ember bed portion 236. Preferably, the simulated ember bed portion 236 is vacuum-formed from plastic and colored so as to resemble an ember bed. The simulated ember bed portion 236 is adapted to receive the simulated fuel portion 234 to form a simulated fuel bed 222. The simulated fuel portion 234 can represent logs of wood (as shown) or, alternatively, lumps of coal (not shown). It is preferred that the simulated ember bed portion 236 resembles an ember bed for the type of fuel represented by the simulated fuel portion 234.

In the embodiment shown in FIG. 5, the simulated fuel bed 222 has a profile 230 viewable by an observer (not shown). In use, the flicker element 28 causes light from the light source 24 to fluctuate or flicker. The fluctuating light is reflected or transmitted from the flicker element 28 to the screen 26. Also, the fluctuating light transmitted through the screen 26 is attenuated and appears as a three-dimensional image. The image of flames which is transmitted through the curved portion 32 of the screen 26 appears to curve around the profile 230 of the simulated fuel bed 222, providing a realistic image of flames. Because of the curvature of the curved portion 32, the three-dimensional image of flames transmitted through the curved portion 32 appears to curve around the simulated fuel bed 222 similarly to flames curling around fuel in a real fire.

Preferably, the flame simulating assembly includes the flame effect element 38, positioned in a path of the fluctuating light between the flicker element 28 and the screen 26. The flame effect element 38 configures the fluctuating light so that an image of flames is transmitted through the screen 26.

Figure 6:
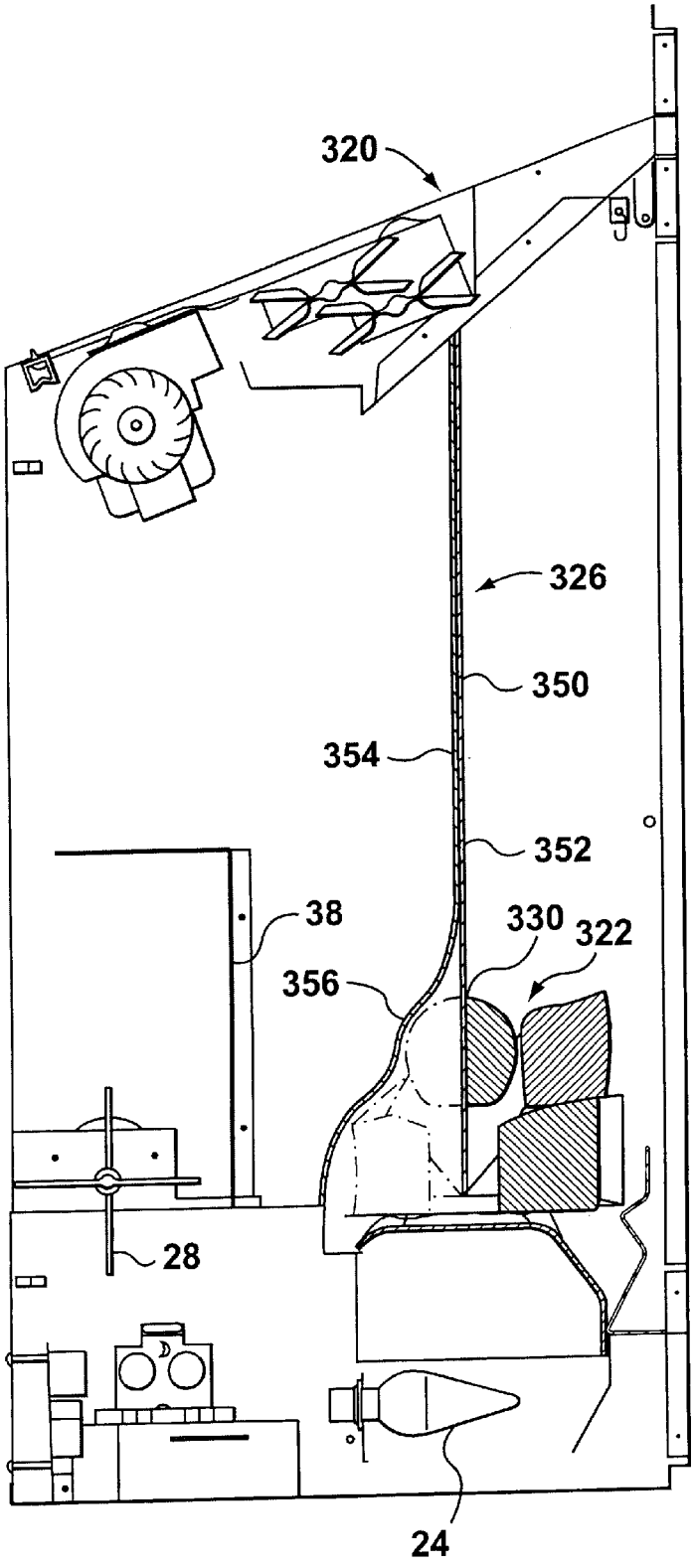
FIG. 6 is a cross-section of yet another embodiment of the flame simulating assembly of the invention.

In another embodiment, shown in FIG. 6, the flame simulating assembly 320 includes a screen 326 which comprises a front member 350 disposed behind the simulated fuel bed 322 having a partially reflective front surface 352 for reflecting and transmitting light, and a diffusing member 354, for diffusing and transmitting light, is disposed behind the front member 350. As can be seen in FIG. 6, the screen 326 is located immediately behind the simulated fuel bed 322 so that the simulated fuel bed 322 is reflected in the partially reflective front surface 352 to give an illusion of depth. The simulated fuel bed 322 is formed to resemble one-half—i.e., the front half—of a real fuel bed. An image of the front half appears in the front surface 352, to provide the appearance of a back half of the simulated fuel bed 322, thereby providing the illusion of depth. Accordingly, the simulated fuel bed 322 has an apparent profile 330 appearing in the partially reflective front surface 352 and viewable by an observer who is observing the flame simulating assembly 320 from the front (not shown). Because of the combination of the simulated fuel bed 322 and the partially reflective front surface 352, the image of flames which is transmitted through the screen 326 appears to arise in the center of the simulated fuel bed 322.

The diffusing member 354 includes a curved portion 356 which is curved in a vertical direction and in a horizontal direction to correspond to the apparent profile 330 of the simulated fuel bed 322, and positioned opposite to the simulated fuel bed 322, behind the front member 350. The curvature, in the vertical direction, of the curved portion 356 of the diffusing member 354 preferably follows the apparent profile 330 of the simulated fuel bed 322 in the partially reflective front surface 352, to give the appearance that the image of flames is emanating from the center of the simulated fuel bed 322 and the image of the simulated fuel bed 322 reflected in the partially reflective front surface 352. Also, the curvature of the curved portion 356 in the horizontal direction preferably tracks the particular angle at which a simulated log appears to lie in the simulated fuel bed 322 and follows the apparent location of the log in the reflective surface 352. At a horizontal position on the simulated fuel bed 322 where no simulated log appears, the curved portion 356 is locally curved to be adjacent the front member 350 to give the appearance that the image of flames is emanating from the embers between the logs of the simulated fuel bed 322.

Preferably, an upper part of the curved portion 356 is generally curved toward the front member 350. This curvature tends to create the illusion to the observer that the image of flames transmitted through the screen 326 is licking over the simulated fuel included in the simulated fuel bed 322. The flame simulating assembly 320 also includes the flicker element 28 positioned in a path of light from the light source 24, for creating the fluctuating light. Accordingly, the fluctuating light transmitted through the screen 326 is attenuated and a three-dimensional image of flames appears to curve around the apparent profile 330 of the simulated fuel bed 322.

It is also preferred that the flame simulating assembly 320 includes a flame effect element 38 positioned in a path of the fluctuating light between the flicker element 28 and the diffusing member 354. As in the other embodiments described above, the flame effect element 38 configures the fluctuating light so that an image of flames is transmitted through the screen 326.

Figure 7:
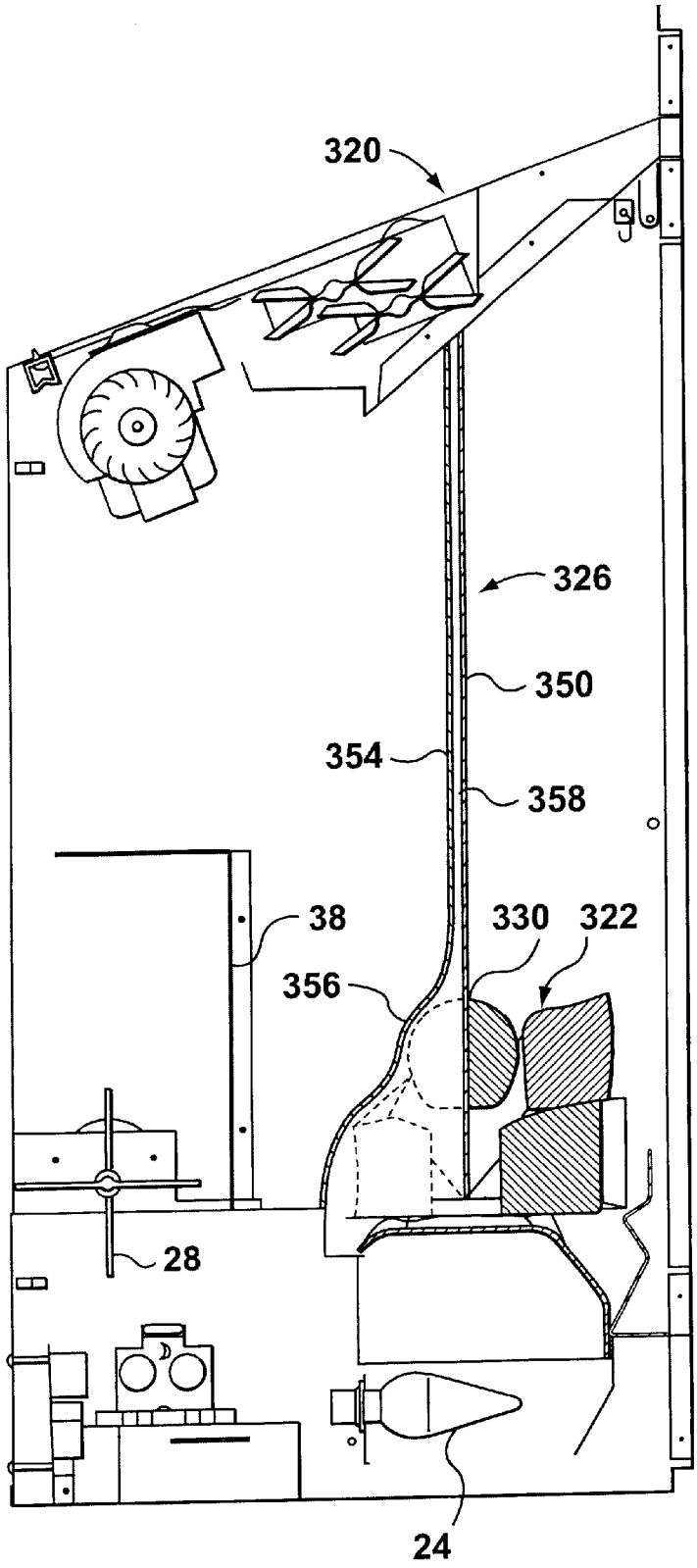
FIG. 7 is a cross-section of yet another embodiment of the flame simulating assembly of the invention.

As shown in FIG. 6, except for the curved portion 356 and the portion of the front member 350 corresponding thereto, the diffusing member 354 and the front member 350 preferably are positioned substantially adjacent to each other. However, as shown in FIG. 7, the diffusing member 354 and the front member 350 can be positioned apart from each other so that an air gap 358 is disposed between the diffusing member 354 and the front member 350 above the curved portion 356. Due to the air gap 358, the image of flames transmitted through the screen 326 is further attenuated.

Figure 8:
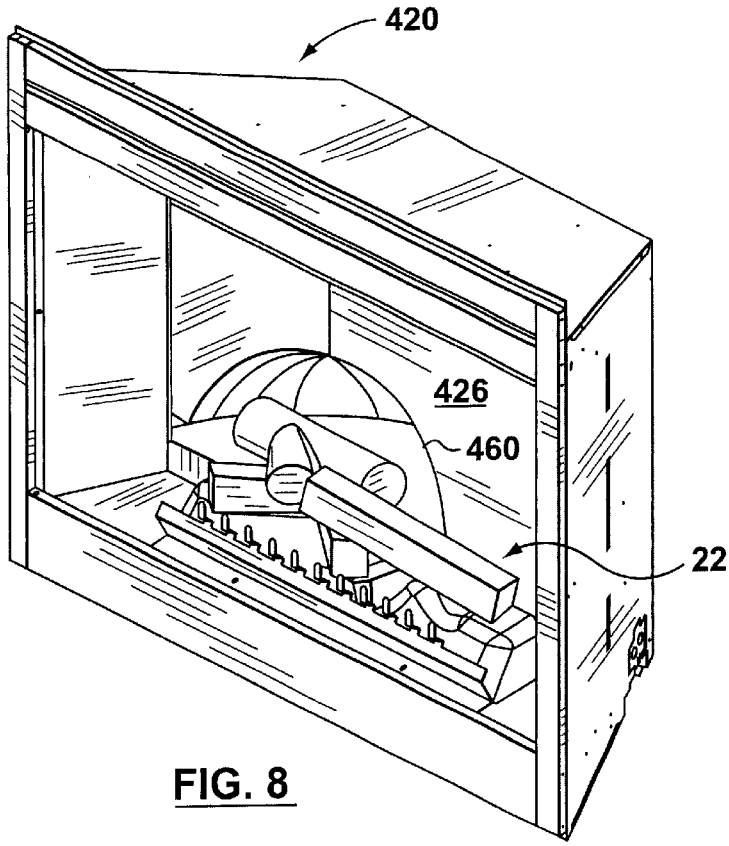
FIG. 8 is an isometric view of yet another embodiment of the flame simulating assembly of the invention, drawn at a smaller scale.
Figure 9:
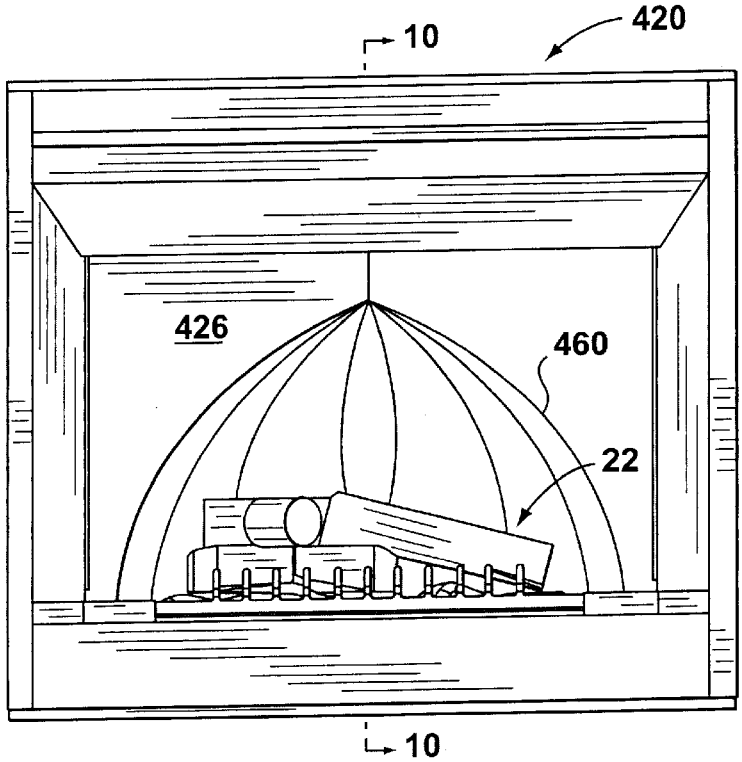
FIG. 9 is a front view of the flame simulating assembly of FIG. 8.
Figure 10:
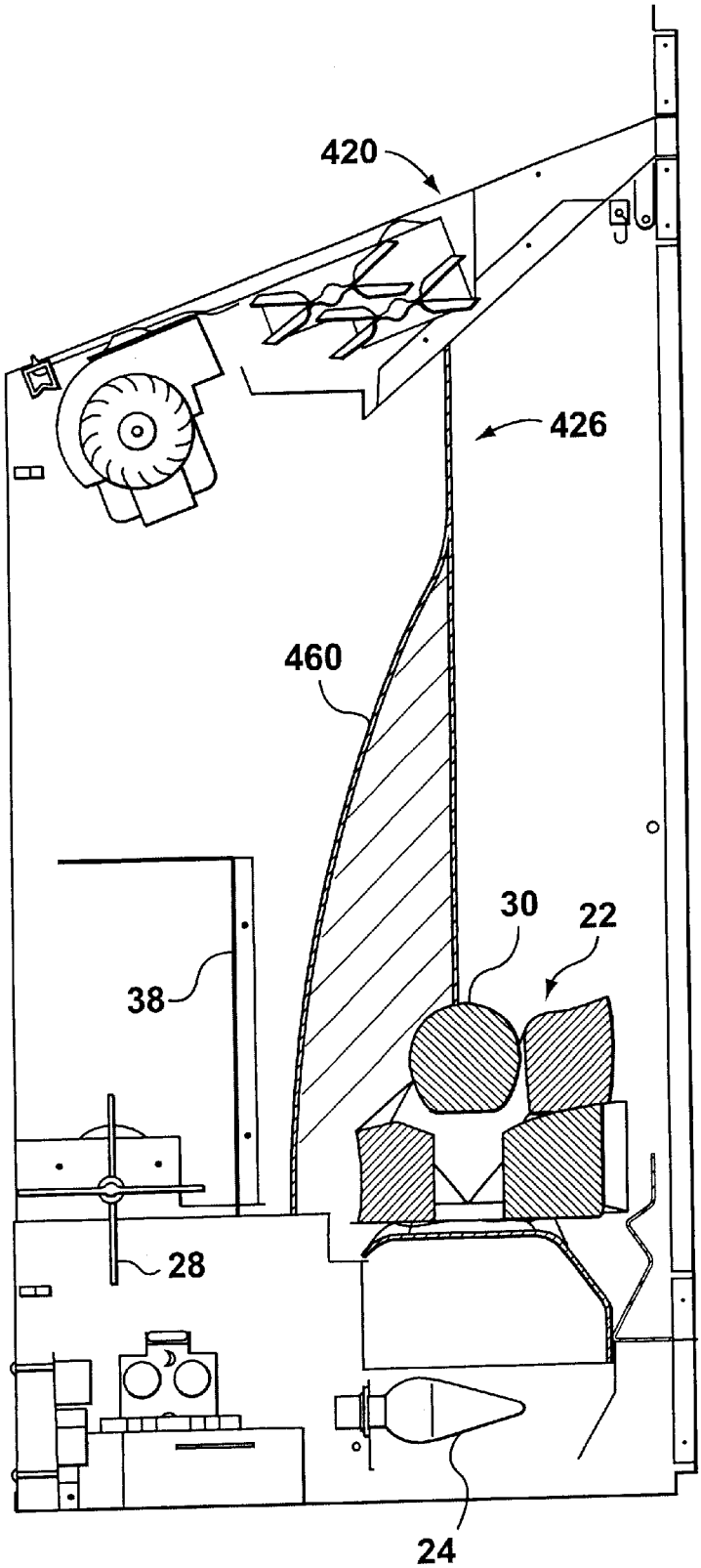
FIG. 10 is a cross-section of the flame simulating assembly of FIG. 8, taken along line 10—10 shown in FIG. 9, drawn at a larger scale.

Another embodiment of the flame simulating assembly 420 is shown in FIGS. 8–10. In the flame simulating assembly 420, a screen 426 includes a conoid concavity 460 positioned substantially adjacent to the simulated fuel bed 22. Preferably, and as can be seen in FIGS. 9 and 10, the conoid concavity 460 extends substantially above the simulated fuel bed 22. The fluctuating light transmitted through the screen 426 is attenuated and a three-dimensional image of flames appears to curve around the simulated fuel bed 22 in the conoid concavity 460.

It is also preferred that the conoid concavity 460 is generally fluted, thereby including a plurality of alternating generally vertically oriented grooves 462 curving inwardly, from bottom to top, for further attenuating the fluctuating light transmitted through the conoid concavity 460. The grooves 462 are preferably configured so that the image of flames transmitted through the conoid concavity 460 further simulates the turbulent and random pattern of real flames. Also, the flame simulating assembly 420 preferably includes the flame effect element 38, positioned in a path of the fluctuating light between the flicker element 28 and the screen 426. The flame effect element 38 configures the fluctuating light so that an image of flames is transmitted through the screen 426.

Figure 11:
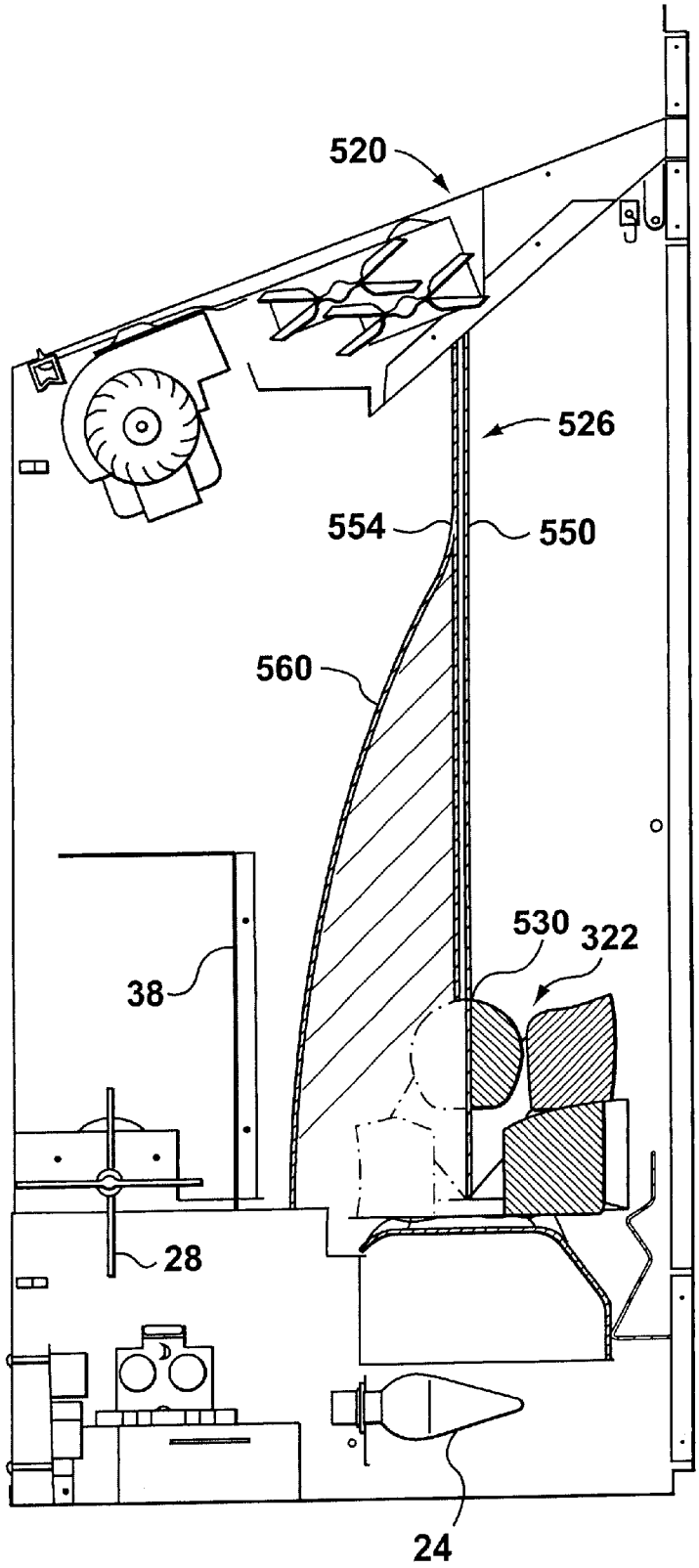
FIG. 11 is a cross-section of yet another embodiment of the flame simulating assembly of the invention.

In yet another embodiment, shown in FIG. 11, the flame simulating assembly 520 includes a screen 526 comprising a front member 550 disposed behind the simulated fuel bed 322 and a diffusing member 554 disposed behind the front member 550. The front member 550 has a partially reflective front surface 552 positioned adjacent to the simulated fuel bed 322. The screen 526 is located immediately behind the simulated fuel bed 322 so that the simulated fuel bed 322 is reflected in the partially reflective front surface 552 to give the illusion of depth. As described, the simulated fuel bed 322 is formed to resemble one-half of a real fuel bed. An image of the simulated fuel bed 322 appears in the partially reflective front surface 552, to simulate the other half of the fuel bed. Accordingly, the simulated fuel bed 322 has an apparent profile 530 appearing in the partially reflective front surface 552 and viewable by an observer (not shown). The diffusing member 554 includes a conoid concavity 560 positioned substantially adjacent to the image of the simulated fuel bed 322 appearing on the partially reflective front surface 552. The fluctuating light transmitted through the screen 526 is attenuated and a three-dimensional image of flames appears to curve around the simulated fuel bed 322 in the conoid concavity 560.

Preferably, the conoid concavity 560 is generally fluted, thereby including a plurality of alternating generally vertically oriented grooves 562 curving inwardly, from bottom to top, for further attenuating the fluctuating light transmitted through the conoid concavity 560. The grooves 562 are preferably configured so that the image of flames transmitted through the conoid concavity 560 further simulates the turbulent and random pattern of real flames. It is also preferred that the flame simulating assembly 520 includes the flame effect element 38, as shown in FIG. 11. The flame effect element 38 configures the fluctuating light so that an image of flames is transmitted to the diffusing member 554.

Figure 12:
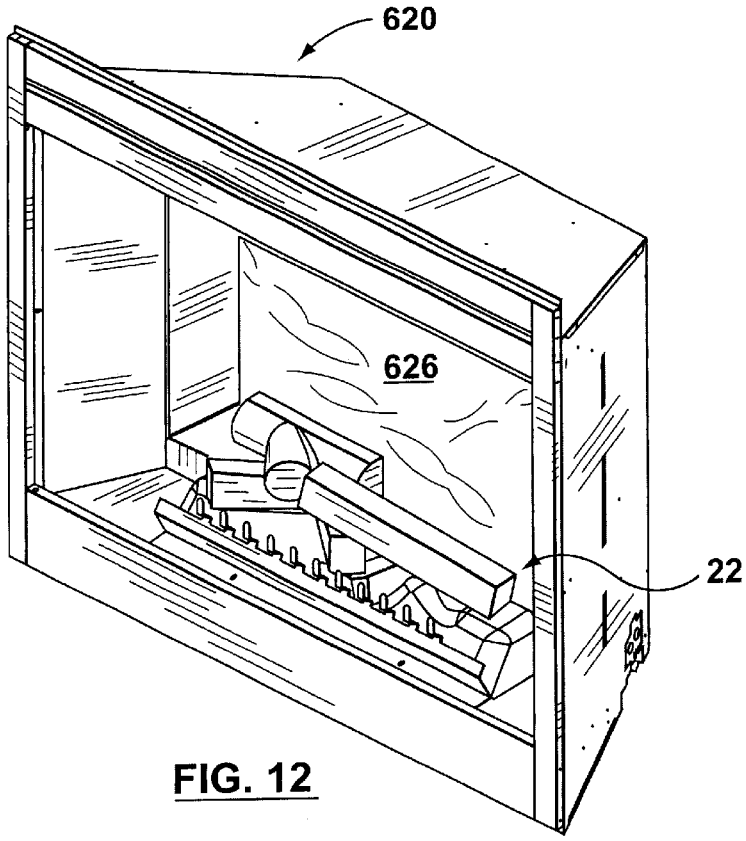
FIG. 12 is an isometric view of yet another embodiment of the flame simulating assembly of the invention, drawn at a smaller scale.
Figure 13:
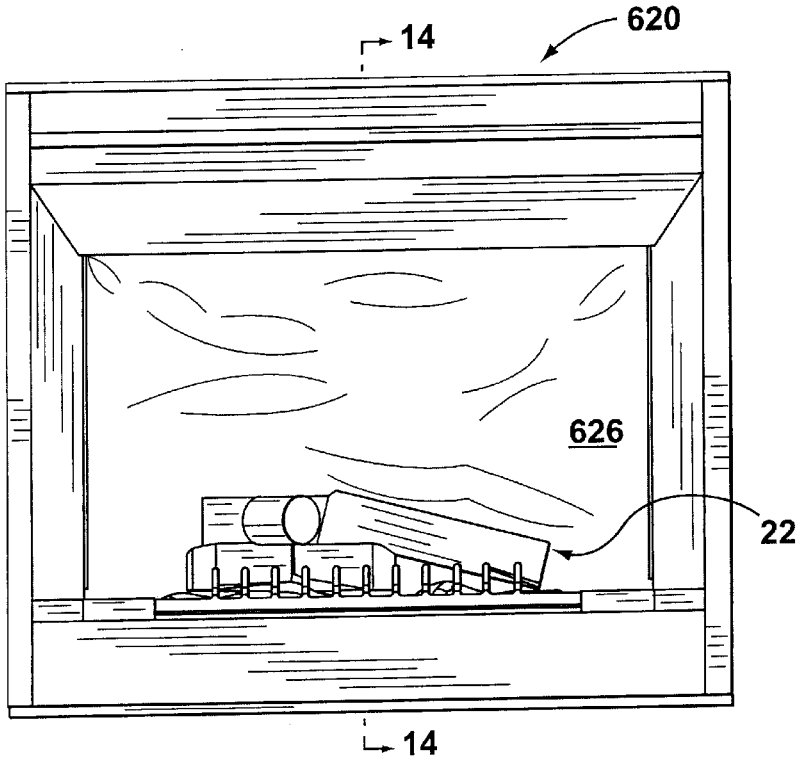
FIG. 13 is a front view of the flame simulating assembly of FIG. 12.
Figure 14:
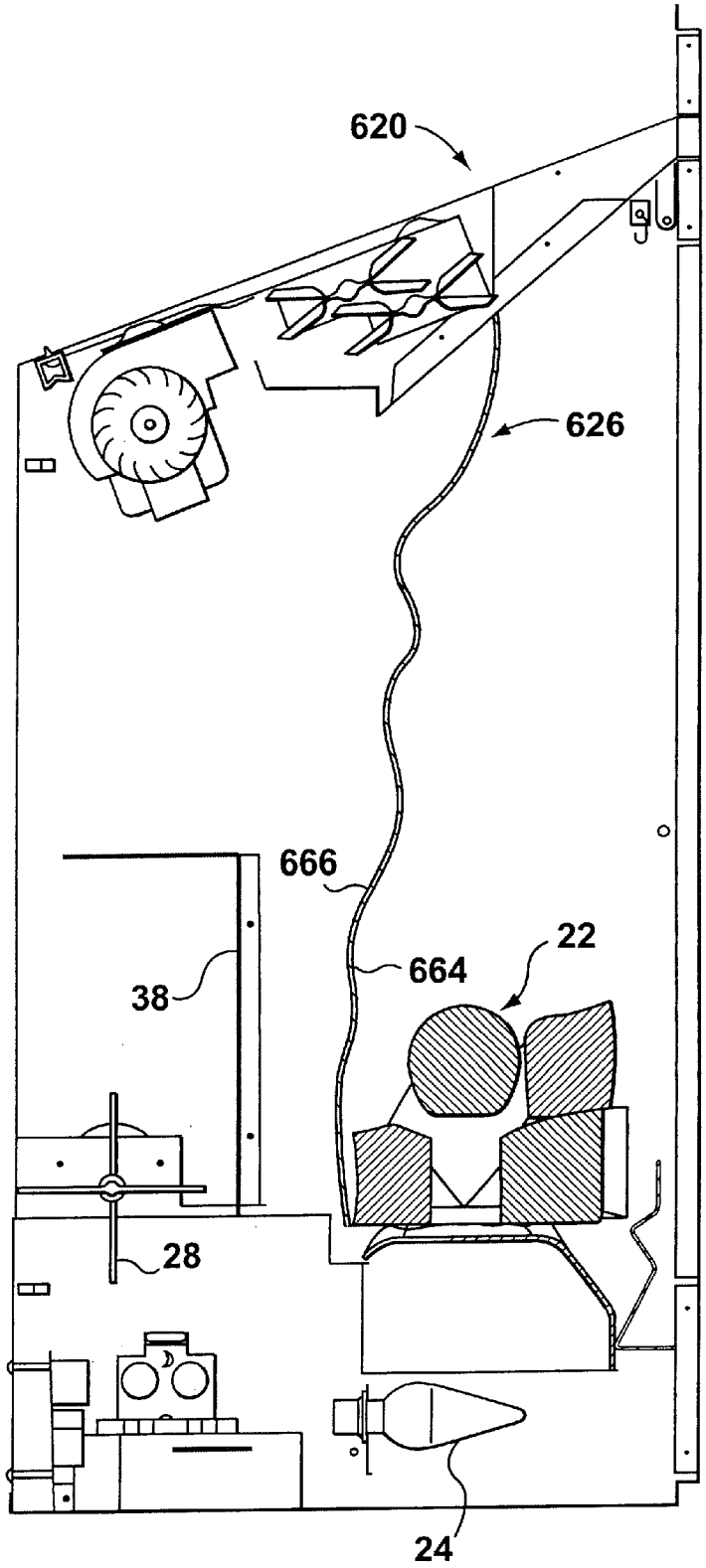
FIG. 14 is a cross-section of the flame simulating assembly of FIG. 12, taken along line 14—14 in FIG. 13, drawn at a larger scale.

In yet another embodiment, as shown in FIGS. 12–14, a flame simulating assembly 620 includes a screen 626 having a front surface 664 disposed behind the simulated fuel bed 22 for diffusing and transmitting light. The screen 626 has a back surface 666 which is curved in a vertical direction and in a horizontal direction in a manner chosen so as to further simulate the turbulent and random pattern of real flames. The curved back surface 666 of the screen 626 is sufficiently spaced from the front surface 664 thereof that the fluctuating light transmitted through the screen 526 is attenuated and a three-dimensional image of flames appears through the screen 626. Preferably, the flame simulating assembly 620 includes the flame effect element 38, as shown in FIG. 14. The flame effect element 38 configures the fluctuating light so that an image of flames is transmitted to the curved back surface 666 of the screen 626.

It will be evident to those skilled in the art that the invention can take many forms, and that such forms are within the scope of the invention as claimed. Therefore, the spirit and scope of the appended claims should not be limited to the description of the preferred versions contained herein.

We claim:

1. A flame simulating assembly for providing an image of flames transmitted in a fluctuating light; viewable by an observer from a front side of the flame assembly, the flame simulating assembly having:

a simulated fuel bed, defining a profile thereof;

a light source;

a substantially vertical screen disposed behind the simulated fuel bed for diffusing and transmitting light, the screen including a curved portion positioned adjacent to the simulated fuel bed;

the curved portion being curved in a vertical direction and in a horizontal direction to correspond to the profile of the simulated fuel bed; and a flicker element for causing light from the light source to fluctuate, thereby creating the fluctuating light, whereby the fluctuating light transmitted through the screen is attenuated by the screen to provide a three-dimensional image of flames which appears to curve around the simulated fuel bed.

2. A flame simulating assembly as claimed in claim 1 additionally including a flame effect element positioned in a path of the fluctuating light between the flicker element and the screen, to configure the fluctuating light.

3. A flame simulating assembly for providing an image of flames transmitted in a fluctuating light viewable by an observer from a front side of the flame simulating assembly, the flame simulating assembly being adapted for use with a simulated fuel bed, the simulated fuel bed defining a profile thereof, the flame simulating assembly having:

a light source;

a substantially vertical screen positioned behind the simulated fuel bed for diffusing and transmitting light;

the screen including a curved portion positioned adjacent to the simulated fuel bed;

the curved portion being curved in a vertical direction and in a horizontal direction to correspond to the profile of the simulated fuel bed; and a flicker element for causing light from the light source to fluctuate, thereby creating the fluctuating light, whereby the fluctuating light transmitted through the screen is attenuated by the screen to provide a three-dimensional image of flames which appears to curve around the simulated fuel bed.

4. A flame simulating assembly as claimed in claim 3 additionally including a flame effect element positioned in a path of the fluctuating light between the flicker element and the screen, to configure the light.

5. A flame simulating assembly for providing an image of flames transmitted in a fluctuating light viewable by an observer from a front side of the flame simulating assembly, the flame simulating assembly being adapted for use with a simulated fuel portion, the flame simulating assembly having:

a simulated ember bed portion, the simulated ember bed portion being adapted to receive the simulated fuel portion to form a simulated fuel bed;

the simulated fuel bed defining a profile thereof a light source;

a substantially vertical screen positioned behind the simulated ember bed portion for diffusing and transmitting light;

the screen including a curved portion, the curved portion being curved in a vertical direction and in a horizontal direction to correspond to the profile of the simulated fuel bed;

the curved portion of the screen being positioned adjacent to the simulated ember bed portion; and a flicker element for causing light from the light source to fluctuate, thereby creating the fluctuating light, whereby the fluctuating light transmitted through the screen is attenuated by the screen to provide a three-dimensional image of flames which appears to curve around the simulated fuel portion.

6. A flame simulating assembly as claimed in claim 5 additionally including a flame effect element positioned in a path of the fluctuating light between the flicker element and the screen, to configure the light.

7. A flame simulating assembly for providing an image of flames transmitted in a fluctuating light, viewable by an observer from a front side of the flame simulating assembly, the flame simulating assembly having:

a simulated fuel bed defining a profile thereof;

a light source;

a substantially vertical screen having a front member disposed behind the simulated fuel bed and a diffusing member disposed behind the front member for diffusing and transmitting light, the front member having a partially reflective front surface for reflecting and transmitting light and the diffusing member including a curved portion;

the curved portion being curved in a vertical direction and in a horizontal direction to correspond to the profile of the simulated fuel bed; the curved portion being positioned adjacent to the simulated fuel bed; and a flicker element for causing light from the light source to fluctuate, thereby creating the fluctuating light, whereby the fluctuating light transmitted through the screen is attenuated by the screen to provide a three-dimensional image of flames which appears to curve around the simulated fuel bed.

8. A flame simulating assembly as claimed in claim 7 in which the diffusing member is spaced apart from the front member, such that the fluctuating light transmitted through the screen is attenuated to provide a three-dimensional image of flames which appears to curve around the simulated fuel bed.

9. A flame simulating assembly as claimed in claim 7 additionally including a flame effect element positioned in a path of the fluctuating light between the flicker element and the diffusing member to configure the fluctuating light.

10. A flame simulating assembly for providing an image of flames transmitted in a fluctuating light; viewable by an observer from a front side of the flame simulating assembly, the flame simulating assembly having:

a simulated fuel bed;

a light source;

a screen having a front surface disposed behind the simulated fuel bed for diffusing and transmitting light;

the screen having a back surface with a curved portion which is curved in a vertical direction and in a horizontal direction, the curved portion being positioned relative to the simulated fuel bed such that the image of flames transmitted through the screen appears to curve around the simulated fuel bed;

a flicker element for causing light from the light source to fluctuate, thereby creating the fluctuating light; and the back surface of the screen being sufficiently spaced from the front surface thereof to result in a three-dimensional image of flames appearing through the screen.

11. A flame simulating assembly as claimed in claim 10 additionally including a flame effect element positioned in a path of the fluctuating light between the flicker element and the screen, to configure the fluctuating light.

12. A flame simulating assembly for providing an image of flames transmitted in a fluctuating light viewable by an observer from a front side of the flame simulating assembly, the flame simulating assembly having:

a simulated fuel bed defining a profile thereof;

the simulated fuel bed being viewable by the observer;

a light source;

a substantially vertical screen positioned behind the simulated fuel bed for diffusing and transmitting light, the screen including a curved portion, the curved portion being curved in a vertical direction and in a horizontal direction to correspond to the profile of the simulated fuel bed; and a flicker element for causing light from the light source to fluctuate, thereby creating the fluctuating light, whereby the fluctuating light transmitted through the screen is attenuated by the screen to provide a three-dimensional image of flames which appear to curve around the simulated fuel bed.

* * * * *

UNITED STATES PATENT AND TRADEMARK OFFICE

CERTIFICATE OF CORRECTION

PATENT NO. : 6,718,665 B2
DATED : April 13, 2004
INVENTOR(S) : Hess et al.

It is certified that error appears in the above-identified patent and that said Letters Patent is hereby corrected as shown below:

Column 8,
Line 22, replace “fluctuating light;” with -- fluctuating light, --.

Column 9,
Line 12, insert -- ; -- after the word “thereof”.

Column 10,
Line 12, replace “fluctuating light;” with -- fluctuating light, --.

Signed and Sealed this

Twenty-seventh Day of September, 2005

JON W. DUDAS
*Director of the United States Patent and Trademark Office*